US006196129B1

(12) United States Patent
Kellett

(10) Patent No.: US 6,196,129 B1
(45) **Date of Patent: *Mar. 6, 2001**

(54) WET LITHOGRAPHIC PRINTING PLATES

(75) Inventor: Richard M. Kellett, Longmeadow, MA (US)

(73) Assignee: New England Sciences & Specialty Products, Inc., Chicopee, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/271,106

(22) Filed: Mar. 17, 1999

Related U.S. Application Data

(63) Continuation-in-part of application No. 09/145,007, filed on Sep. 1, 1998, now Pat. No. 5,971,535, which is a continuation of application No. 09/005,410, filed on Jan. 9, 1998, now Pat. No. 5,849,066, which is a division of application No. 08/645,747, filed on May 14, 1996, now Pat. No. 5,738,013.

(51) Int. Cl.[7] ..... B41C 1/10

(52) U.S. Cl. ..... 101/467; 101/454; 101/460; 101/465

(58) Field of Search ..... 101/453, 454, 101/457, 458, 460, 462, 463.1, 465–467; 347/2, 96, 100, 102

(56) References Cited

U.S. PATENT DOCUMENTS

| | | | | |
|---|---|---|---|---|
| 3,673,962 | * | 7/1972 | Sagawa | 101/467 |
| 4,038,253 | * | 7/1977 | Kramer | 101/453 |
| 4,121,522 | * | 10/1978 | Sharkey et al. | 101/463.1 |
| 4,486,526 | * | 12/1984 | Thomas et al. | 430/302 |
| 5,006,862 | * | 4/1991 | Adamic | 347/101 |
| 5,312,654 | * | 5/1994 | Arimatsu et al. | 347/95 |
| 5,380,769 | * | 1/1995 | Titterington et al. | 347/96 |
| 5,501,150 | * | 3/1996 | Leenders et al. | 101/466 |
| 5,542,972 | * | 8/1996 | Von Der Eltz et al. | 347/96 |
| 5,738,013 | * | 4/1998 | Kellett | 101/463.1 |
| 5,820,932 | * | 10/1998 | Hallman et al. | 101/466 |
| 5,849,066 | * | 12/1998 | Kellett | 106/31.13 |
| 5,971,535 | * | 10/1999 | Kellett | 347/96 |

* cited by examiner

*Primary Examiner*—Stephen R. Funk
(74) *Attorney, Agent, or Firm*—Sampson & Associates, P.C.

(57) ABSTRACT

Provided is an imaged wet lithographic printing plate which bears a hydrophilic layer and an oleophilic, water-insoluble layer in a desired imagewise pattern overlying the hydrophilic layer, wherein the oleophilic layer comprises a reaction product of a transition metal complex of an organic acid, preferably a chromium complex of an organic carboxylic acid. Also provided are methods of preparing such imaged wet lithographic plates by ink jet printing and by laser ablation imaging; methods of preparing positive working, wet lithographic printing plates imageable by laser radiation; positive working, wet lithographic printing plates prepared by such methods; and methods of imaging such positive working plates by laser ablation imaging.

115 Claims, 1 Drawing Sheet

WET LITHOGRAPHIC PRINTING PLATES

RELATED APPLICATION

This application is a continuation-in-part of U.S. patent application Ser. No. 09/145,007, filed Sep. 1, 1998, now U.S. Pat. No. 5,971,535, which is a continuation of U.S. patent application Ser. No. 09/005,410, filed Jan. 9, 1998, now U.S. Pat. No. 5,849,066, which is a divisional of U.S. patent application Ser. No. 08/645,747, filed May 14, 1996, now U.S. Pat. No. 5,738,013.

FIELD OF THE INVENTION

The present invention relates generally to the field of wet lithographic printing plates. More particularly, the present invention pertains to a media and fluid material set which comprises (a) a media with a support that bears a hydrophilic layer; and (b) a fluid material comprising a liquid carrier medium and a reactive component, which comprises a transition metal complex of an organic acid. The reactive component reacts after application of the fluid material to the media to form an ink-accepting layer on the surface. The present invention pertains to wet lithographic printing plates with ink-accepting layers comprising such reaction products and such plates capable of being imaged using laser-induced thermal ablation and also pertains to imaged wet lithographic printing plates with such ink-accepting layers, made by an ink-jet printing application, by laser-induced thermal ablation, or by other imaging processes, and methods of making such wet lithographic printing plates.

BACKGROUND OF THE INVENTION

Throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

Lithographic printing has long been the most widely used printing technique, especially for short to medium printing run lengths of 1,000 to 15,000. The term "lithographic" is meant to include various terms used synonymously, such as offset, offset lithographic, planographic, and others. Most lithographic plates are still produced photographically. The disadvantages of this and some of the alternative lithographic plate materials and processes are described in U.S. Pat. Nos. 4,958,563 and 5,487,338.

With the advent of the computer in revolutionizing the graphics design process leading to printing, there have been extensive efforts to develop a convenient and inexpensive computer-to-plate system, particularly for use in lithographic printing. Many of the new computer-to-plate systems are large, complex, and expensive. They are designed for use by large printing companies as a means to streamline the prepress process of their printing operations and to take advantage of the rapid exchange and response to the digital information of graphics designs provided by their customers. There remains a strong need for an economical and efficient computer-to-plate system for the many smaller printers who utilize lithographic printing.

A number of electronic, non-impact printing systems have been investigated for use in making lithographic printing plates to satisfy the needs of these smaller printers. Foremost among these have been laser printing systems, for example, as described in U.S. Pat. No. 5,304,443 and references therein. These have had some limited success, but have not been able to overcome the disadvantages of undesired background toner imaging, limitation to small sizes (approximately 11 inches by 18 inches) which are too small for many applications, and limitation to only those flexible substrates such as paper and plastic films which can transport through the laser printers.

Another non-impact printing system which has received attention for economical and convenient computer-to-plate preparation for lithographic printing is thermal transfer printing, for example, as described in U.S. Pat. No. 4,958,564. This involves the printing of a hydrophobic wax or resin material onto the lithographic printing blank. This approach has similar size and flexible substrate limitations as described above for laser printing. In addition, the nature of the thermal transfer process is very demanding on intimate contact of the wax or resin donor ribbon to the receiver substrate to obtain consistent image quality. For this latter reason especially, the low cost thermal transfer printers in wide use for hard copy color output printing from computers are not used to prepare lithographic printing plates. Instead, more expensive, specially built thermal transfer printers have been proposed. The only widely used printers for hard copy computer output that have seen some use in making lithographic plates are laser printers, in spite of their aforementioned disadvantages.

In recent years, ink jet printers have replaced laser printers as the most popular hard copy output printers for computers. Some of the competitive advantages of ink jet printers have been low cost, reliability, and the ability to make color images without significantly increasing the cost of the printer. Both thermal ink jet and piezoelectric ink jet printing methods have been widely adopted for desktop computer printing. A third conventional type of ink jet printing, a continuous flow type method, has found acceptance in high quality color printing and proofing in graphics applications.

In spite of the very large and rapidly growing installed base of low cost desktop ink jet printers as well as a large number of higher cost, larger size ink jet printers used in prepress proofing and in printing output, there has not been use of these ink jet printers to make lithographic printing plates. There have been some reports in the literature proposing the use of ink jet printers to make lithographic printing plates. In Japanese Kokai 62-25081, an oleophilic liquid or fluid ink was printed by ink jet printing onto a hydrophilic aluminum surface of a lithographic printing plate. Titanate or silane coupling agents were present in the ink.

An ink jet printing apparatus to make lithographic printing plates is described in PCT WO 94/11191. It is directed to depositing hydrophobic or hydrophilic substances on hydrophobic printing plates.

In U.S. Pat. No. 5,501,150, a fluid ink and hydrophilic media set containing materials to produce a silver-reducible image by ink jet printing are used to make a metallic silver image which, following wet processing to make the silver image sufficiently hydrophobic, is said to provide a lithographic printing plate.

Ink jet printing where the ink is a solid or phase change type ink instead of a liquid or fluid type ink is described in U.S. Pat. No. 4,833,486 to deposit a hot wax on a surface of an offset plate. Upon cooling of the wax, it solidifies, thereby providing a printing plate. Solid ink jet printing has serious disadvantages for lithographic plates in that the wax or resin image has limited durability due to its thermoplastic, chemical, and adhesive properties and the amount and rounded shape of the solidified ink jet droplet on the media do not have the intrinsic image resolution properties found in liquid or fluid ink jet printing.

The use of ink jet printing to apply an opaque image or mask pattern to a photosensitive lithographic printing plate blank, is described in Japanese Kokai 63-109,052. The blank is then exposed through the ink jet imaged mask pattern and then processed by conventional means to provide a lithographic printing plate. This approach retains the materials and processing of conventional lithographic printing plates and only uses inkjet printing as an alternative in the photomask through which the conventional plates are exposed. Thus this approach adds to the complexity and expense of the platemaking process and does not depend on the ink jet ink image for the hydrophobic image of the plate. U.S. Pat. No. 5,495,803 describes a solid or phase change type of ink jet printing to form a photomask for a printing plate.

Much of the technical development in ink jet printing has been directed to color and black imaging for computer hard copy output. The need for more archival, durable, and waterfast imaged media has led to ink jet inks and receiver media that contain chemically reactive components. For example, U.S. Pat. No. 5,429,860 describes a reactive ink jet ink/media set where the receiver media has a reactive component which reacts with the ink to give a more durable image and reacts in the non-image areas to give a durable coating. The '860 patent is directed to durable colorant imaging elements and has no teaching on durable oleophilic material imaging elements or production of lithographic printing plates, which are the subjects of the present invention. U.S. Pat. No. 5,006,862 describes the use of reactive colorants in the liquid ink jet ink or fluid to provide more durable, waterfast, and bleed resistant images when printed on the media. These approaches for archival, more durable color and black ink jet images do not address the requirements for a durable hydrophobic image suitable for a lithographic printing plate. It would be advantageous to have a liquid ink jet ink or fluid that could be used on the large installed and future base of ink jet printers, now used extensively to print colorants on media, to print a durable oleophilic and water-insoluble image, particularly for use on a suitable lithographic printing plate blank to make a lithographic printing plate.

Another non-impact printing system which has received attention for economics and convenient computer-to-plate preparation for lithographic printing is laser ablation imaging. Examples of laser-induced thermal ablation techniques for computer-to-plate applications include U.S. Pat. Nos. 5,339,737; 5,353,705; and 5,493,971. Laser ablation imaging has been utilized for both of the main types of lithographic printing plates: wet lithographic printing plates and dry or waterless lithographic printing plates.

By the term "wet lithographic," as used herein, is meant the type of lithographic printing plate where the inking areas of the plate that receive the printing ink from the ink roller and then transfer this ink to the receiving media, such as a type of paper, are ink-accepting or oleophilic and where the non-inking areas of the plate that do not accept printing ink from the ink roller and thus do not transfer any ink to the receiving media are hydrophilic and receive an aqueous dampening or fountain solution during the printing process before contact with the ink roller. This aqueous or "wet" layer in the non-inking areas renders these areas ink repellent or oleophobic to the printing ink, but does not affect the oleophilic character of the ink-accepting areas. By the term "positive working," as used herein, is meant that the inking or image areas of the plate that receive the printing ink are not removed by the laser ablation imaging method of preparing the imaged wet lithographic plate. By the term "printing plate" or its equivalent term "plate," as used herein, is meant any type of printing member or surface capable of recording an image defined by regions exhibiting differential affinities for ink and/or fountain solution.

Accordingly, it is an object of this invention to provide a liquid ink jet ink or fluid that provides an oleophilic, durable, and water-fast image upon ink jet printing.

Another object of this invention is to provide a liquid ink jet fluid-media set that provides an oleophilic, durable, and water-fast image with a hydrophilic, durable non-image area. It is a further object of this invention that this liquid ink jet fluid-media set provides an imaged printing plate suitable for high quality lithographic printing.

It is a further object of this invention that the liquid ink jet fluid-media set be capable of being printed on conventional, low cost desktop ink jet printers to provide an imaged printing plate suitable for high quality lithographic printing. Yet another object of this invention is that the liquid ink jet fluid-media set is capable of being printed on conventional large format ink jet printers with printing widths and lengths in excess of 24 inches to provide an imaged printing plate suitable for high quality lithographic printing. Still another object of this invention is that the liquid ink jet fluid-media set is capable of being printed on ink jet printers of all sizes with a wider choice of rigid and flexible media than with laser and other non-impact printers to provide an imaged printing plate suitable for high quality lithographic printing.

It is a further object of this invention that no wet processing step, before or after the ink jet printing, is required to provide an imaged printing plate suitable for high quality lithographic printing.

It is another object of this invention that no colorant is required in the liquid ink jet fluid to provide an oleophilic, durable, and waterfast image and to provide an imaged printing plate suitable for high quality lithographic printing.

It is a further object of this invention that no metal precursor is required in the liquid ink jet fluid or the media and no metal is required in the image areas to provide an oleophilic, durable, and water-fast image and to provide an imaged printing plate suitable for high quality lithographic printing.

Still another object of this invention is to provide a convenient and economical method to provide an imaged printing plate suitable for high quality lithographic printing.

Yet another object of this invention is to provide an ink-accepting material, which is applicable for positive-working wet lithographic printing plates and provides a tough, durable, thin, and water-insoluble surface layer with excellent ink-accepting properties, and which may be effectively utilized in a computer-to-plate imaging process, that is based on laser-induced thermal ablation.

These and other objects of the present invention will become apparent upon a review of the following specification and the claims appended thereto.

SUMMARY OF THE INVENTION

In accordance with the foregoing objectives, there is provided by the present invention an ink jet liquid or fluid containing an organic or transition metal complex reactive component and a hydrophilic media. Such a media and fluid composition is, in general, useful as novel materials in the preparation of a lithographic printing plate, as well as of durable, waterfast imaged materials. In a preferred embodiment, the ink jet fluid contains isocyanates, blocked isocyanates, diketenes, diketene emulsions, polyamide epoxides, acid anhydrides, acid chlorides, or chromium complexes of organic acids as the reactive component. Upon ink jet printing on a hydrophilic media and subsequent exposure to an external energy source or another suitable means, an oleophilic, durable, and water-insoluble imaged media with hydrophilic non-image areas is obtained.

It is most preferred that the ink jet fluid contains blocked isocyanates, diketene emulsions, or chromium complexes of organic acids as the reactive component.

A process for the production of such an imaged lithographic printing plate using ink jet printing is also provided herewith.

One aspect of the present invention pertains to an imaged wet lithographic printing plate comprising (a) a support that bears a hydrophilic layer in the ink-repelling areas of the support; and (b) an ink-accepting, water-insoluble layer in a desired imagewise pattern overlying the hydrophilic layer of the support, wherein said ink-accepting layer comprises a reaction product of a transition metal complex of an organic acid. In a preferred embodiment of the imaged wet lithographic plates of the present invention, the transition metal complex is a chromium complex, and more preferably, the chromium complex comprises a Werner complex of trivalent chromium and an organic carboxylic acid. In a most preferred embodiment, the organic carboxylic acid of the Wemner complex of this invention is selected from the group consisting of non-cyclic and cyclic carboxylic acids having 4 to 18 carbon atoms, such as, for example, myristic acid and stearic acid.

In one embodiment of the imaged wet lithographic plates of this invention, the hydrophilic layer in the ink-repelling areas of the support comprises a hydrophilic material selected from the group consisting of: polyvinyl alcohols and copolymers thereof; cellulosic polymers; polyacrylates and copolymers thereof; polymethacrylates and copolymers thereof; polymaleic anhydrides and derivatives and copolymers thereof, polyvinyl pyrrolidones and copolymers thereof; polyamides; inorganic polymers; and aluminum oxides; and preferably, the aluminum oxides are selected from the group consisting of: aluminum boebmites; gamma-aluminum oxides; alpha-aluminum oxides; aluminum oxides formed by the oxidation of aluminum metal by oxygen; and aluminum oxide formed by an anodization process. In a more preferred embodiment, the hydrophilic material is a polyvinyl alcohol. In a most preferred embodiment, the reaction product in the ink-accepting layer comprises a reaction product of the transition metal complex of an organic acid with one or more of the hydrophilic materials in the hydrophilic layer of the support.

In one embodiment, the support of the imaged plates of the present invention is a paper. In one embodiment, the support of the imaged plates of this invention is a polymeric plastic film. In one embodiment, the support of the imaged plates of the present invention is a metal, preferably aluminum.

Another aspect of the present invention pertains to a positive working, wet lithographic plate imageable by laser radiation, comprising (a) an ink-accepting, oleophilic, and water-insoluble surface layer comprising a reaction product of a transition metal complex of an organic acid, as described herein and, (b) a support that bears a hydrophilic layer comprising one or more hydrophilic materials, as described herein.

Another aspect of the present invention pertains to a method of preparing an imaged, wet lithographic printing plate, comprising the steps of (a) providing a support that bears a hydrophilic layer; (b) applying a fluid material comprising a liquid carrier medium and a reactive component, the reactive component comprising a transition metal complex of an organic acid, to the hydrophilic layer; (c) removing the liquid carrier medium; (d) reacting the transition metal complex, thereby forming an ink-accepting, water-insoluble layer on the hydrophilic layer; and, (e) exposing the ink-accepting layer to laser radiation in a desired imagewise pattern, thereby ablating the ink-accepting layer in the exposed region thereof to thereby reveal the hydrophilic layer of the support in the desired imagewise pattern. In a preferred embodiment, the transition metal complex reacts in step (d) upon exposure to heat, and most preferably, the transition metal complex reacts in step (d) with one or more materials of the hydrophilic layer of the support. In a preferred embodiment of the method of preparing an imaged wet lithographic plate of this invention, the transition metal complex is a chromium complex of an organic acid, and preferably, the chromium complex comprises a Werner complex of trivalent chromium and an organic carboxylic acid. In a most preferred embodiment, the organic carboxylic acid of the Werner complex is selected from the group consisting of non-cyclic and cyclic carboxylic acids having 4 to 18 carbon atoms, such as, for example, myristic acid or stearic acid. In one embodiment, the fluid material of step (b) further comprises a sensitizer, and, preferably, the sensitizer is an infrared-absorbing compound.

The positive working, wet lithographic printing plates of the present invention may have a variety of constructions of layers for the support and for intermediate layers between the support and the ink-accepting, water-insoluble surface or first layer comprising the reaction product of a transition metal complex of an organic acid. For example, another aspect of this invention pertains to a positive working, wet lithographic printing plate imageable by laser radiation, the plate comprising (a) an ink-accepting first layer comprising a reaction product of a transition metal complex of an organic acid, as described herein; (b) a hydrophilic second layer underlying the first layer; and (c) a support. In one embodiment, the support is hydrophilic. In a preferred embodiment, when the support is hydrophilic, the second layer is characterized by ablative absorption of laser radiation. In another embodiment, the support is oleophilic. In one embodiment, the support is hydrophilic, and the second layer is oleophilic instead of hydrophilic and is further characterized by ablative absorption of laser radiation. Also, for example, another aspect of this invention pertains to a positive working, wet lithographic printing plate imageable by laser radiation, comprising (a) an ink-accepting first layer comprising a reaction product of a transition metal complex of an organic acid, as described herein; (b) a second layer underlying the first layer, the second layer being characterized by ablative absorption of laser radiation; (c) a hydrophilic third layer underlying the second layer; and (d) a support. Illustrating the versatility of product designs possible with the ink-accepting, water-insoluble surface layer of this invention, for example, in one embodiment, the second layer is hydrophilic. In one embodiment, the third layer is characterized by the absence of ablative absorption of laser radiation.

Also provided are methods of preparing positive working, wet lithographic printing plates imageable by laser radiation.

One aspect of the present invention pertains to methods of imaging, comprising the steps of (a) providing a positive working, wet lithographic printing plate, as described herein; and, (b) imagewise directing laser radiation to ablate the first ink-accepting layer in the exposed regions thereof to form an image. In one embodiment of the methods of imaging of this invention, subsequent to step (b), there is a further step (c) comprising contacting the plate with a cleaning solution to remove residue present from the exposed regions. In one embodiment, the cleaning solution of step (c) comprises water. In one embodiment, subsequent to the further step (c), the plate is inked and used in press runs. In one embodiment, the plate is mounted on a printing press before step (b) is carried out.

DETAILED DESCRIPTION OF THE PREFERRED EMBODIMENTS OF THE INVENTION

Figure 1:
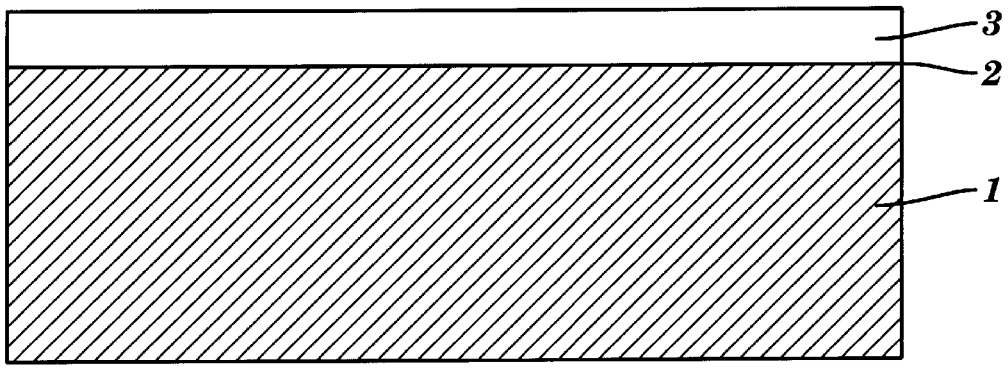
FIG. 1 shows a cross-section of one embodiment of a lithographic printing plate of the present invention for use in preparing positive working, wet lithographic printing plates by laser ablation imaging.

One aspect of the present invention pertains to a media/fluid material set for use in preparing positive working, wet lithographic printing plates, comprising (a) a media comprising a support that bears a hydrophilic surface; and, (b) a fluid material comprising a liquid carrier medium and a reactive component, which reactive component comprises a transition metal complex of an organic acid, wherein the complex reacts after the application of the fluid material on the hydrophilic surface and thereby forms an ink-accepting, water-insoluble surface layer. Such a fluid material and media are, in general, useful as novel materials in the preparation of a lithographic printing plate, as well as of durable, waterfast imaged materials. The oleophilic, durable, and water-insoluble imaged media with hydrophilic non-image areas of the imaged wet lithographic printing plates of the present invention are particularly advantageous because the imaging method is positive working. The media/fluid material sets of the present invention are particularly preferred for use in preparing positive working, wet lithographic printing plates imaged by laser-induced thermal ablation or, alternatively, by an ink jet printing application.

Transition Metal Complexes of Organic Acids

The term "tansition metal," as used herein, means the elements of the First, Second, and Third Transition Metal Series of Groups IB to VIIIB in the Periodic Table and includes, but is not limited to, Cr, Zn, Sn, Fe, Co, V, Ti, Ni, Cu, Y, Zr, Nb, Mo, Ru, Rh, Pd, Hf, Ag, Au, Pt, Hg, Ta, W, Re, Os, Ir, and Mn. The term "complexes" or "complex," according to the *McGraw Hill Dictionary of Scientific Terms*, Fifth Edition, McGraw-Hill Inc., New York, 1994, and as used herein, means those components in which a part of the molecular bonding is of the coordinate type in which a chemical bond between two atoms is formed by a shared pair of electrons, and the pair of electrons has been supplied by one of the two atoms. One of the two atoms in the coordinate type bond is a transition metal in the complexes of the present invention. The term "organic acids," as used herein, means acids having carbon atoms in the molecule. The acidic functional groups of the organic acids of the present invention may be any known in the art and include, but are not limited to, carboxylic acid groups, sulfonic acid groups, and phosphoric acid groups.

The transition metal elements, such as chromium, have a large atomic radius and exist in highly charged ionic states, such as trivalent chromium. As such, these transition metal elements readily form complexes with a wide variety of compounds, such as, for example, organic acids. The use of transition metal elements provides an effective approach to form stable complexes of potentially reactive materials which may be conveniently applied to a desired surface and then reacted by an external energy source or by another method, such as exposure to a catalyst or to another material that reacts with the complex, to form a reaction product with desirable properties, such as, oleophilic properties, durability and water insolubility.

In a preferred embodiment of the wet lithographic printing plates of the present invention, the transition metal complex of an organic acid is a chromium complex. In a more preferred embodiment, the chromium complex comprises a Werner complex of trivalent chromium and an organic carboxylic acid. Werner complexes of trivalent chromium and organic carboxylic acids are available commercially, as, for example, the Werner complexes of trivalent chromium and myristic or stearic acid in isopropyl alcohol, as described in *Quinlon Chrome Complexes*, Dupont Corporation, April 1992. In a most preferred embodiment, the organic carboxylic acid of the Werner complexes of the wet lithographic printing plates of this invention is selected from the group consisting of non-cyclic and cyclic carboxylic acids having 4 to 18 carbon atoms, such as, for example, myristic acid and stearic acid.

Since the transition metal complexes of organic acids are typically not polymeric, the reaction products of a transition metal complex of an organic acid in the surface layers of the present invention may be polymeric or not polymeric, depending on the nature of the reaction and whether a co-reacting material, such as a polymeric material, is present. Although the reaction products in the surface layers of this invention are typically not polymeric, they provide exceptional ink-accepting, oleophilic, water-insolubility, and durability properties, including in very thin surface layers of one or only a few monolayers of reaction products.

Copending U.S. patent application Ser. No. 09/082,764, titled "Waterless Lithographic Printing Plates," filed May 21, 1998, now U.S. Pat. No. 6,051,365, to the common assignee, the disclosure of which is fully incorporated herein, describes the use of reactive transition metal complexes of fluorinated organic acids for use in preparing waterless lithographic printing plates.

Fluid Materials for Preparing Wet Lithographic Printing Plates

The fluid materials for use in manufacturing positive working, wet lithographic plates of the present invention comprise a liquid carrier medium and a reactive component, wherein the reactive component comprises a transition metal complex of an organic acid, as described herein. Preferably, the transition metal complex is a chromium complex, and more preferably, the transition metal complex comprises a Werner complex of trivalent chromium and an organic carboxylic acid. Most preferably, the organic carboxylic acid of the Werner complex is selected from the group consisting of non-cyclic and cyclic carboxylic acids having 4 to 18 carbon atoms, such as, for example, myristic acid and stearic acid.

The choice of the liquid carrier medium for the fluid materials of this invention may vary widely and includes water, organic solvents, and combinations thereof. Suitable organic solvents typically are polar and include, but are not limited to, alcohols, such as isopropyl alcohol; ketones, such as acetone; and, sulfoxides, such as dimethyl sulfoxide. Because of their compatibility with the transition metal complexes of organic acids, one or more aliphatic alcohols of 1 to 4 carbon atoms, such as isopropyl alcohol, are preferred, and more preferably, one or more of these alcohols in a mixture with water. The choice of the liquid carrier medium depends mainly on the particular reactive component utilized in the fluid material, on the compatibility of the reactive component with the liquid carrier medium, on the type of method of application of the fluid material to the support with the support having a hydrophilic or non-hydrophilic surface, and on the requirements for wettability and other coating application properties of the particular surface of the support. A wider choice of the liquid carrier medium exists when the fluid material is applied to the full surface of the media by a conventional coating application, such as gap blade coating, reverse roll coating, or gravure coating. A narrower choice of the liquid carrier medium generally exists when the fluid material is applied to the surface of the media or support using an ink jet printing application, either over the full surface of the media or, preferably, in a desired imagewise pattern. The use of an ink jet printing application introduces further requirements on the liquid carrier medium of compatibility, stability and consistent performance of the fluid material in the ink jet printing cartridge during storage and during ink jet printing. For special coating application techniques, such as an ink jet printing application, the suitability of the liquid carrier medium typically needs to be determined by experimentation in the particular coating application technique selected and with the complete fluid material composition, including any other additives besides the reactive component, present.

The fluid material may be applied to the surface of the media either on the entire surface or in a pattern on the surface. For use in positive working, wet lithographic printing plates, application of the fluid material on the full surface is typically an intermediate step in making the positive working, wet lithographic printing plate and precedes a subsequent step of removing the ink-accepting layer on the full surface of the media in selected areas in a desired pattern, such as by laser-induced thermal ablation. In the case of removing the ink-accepting layer in a desired pattern, this preferably reveals the hydrophilic surface of the media, which is typically suitable for ink-repelling, non-image areas for use in wet lithographic printing with the ink-repelling background areas being the areas where the ink-accepting layer was removed.

Supports and Hydrophilic Layers for Preparing Wet Lithogaphic Printing Plates

The supports for the positive working, wet lithographic printing plates of this invention comprise a support that bears a hydrophilic layer. As described herein, the hydrophilic layer may be an integral part of the support such as, for example, a hydrophilic surface of a metal support; may be a layer in contact to the support; or may be an intermediate layer interposed between the ink-accepting surface layer and the support with one or more additional layers between the hydrophilic layer and the support and/or between the hydrophilic layer and the ink-accepting surface layer. A wide variety of hydrophilic layers may be utilized with the supports. Requirements for the hydrophilic receiving layer include generally, for example, that the hydrophilic layer is receptive to the application of the fluid material on the hydrophilic layers in terms of wettability and other desired coatability properties such as coating uniformity; that interaction with the reactive component in the fluid material provides a durable, strongly adhering ink-accepting layer; and that the ink-repelling properties needed for high quality wet lithographic printing are provided if the hydrophilic layer is the desired ink-repelling area in the imaged wet lithographic plates. Since the fluid material in this invention comprises a reactive component which reacts, for example, after application of the fluid material on the hydrophilic layer to form an ink-accepting layer, it is often desirable that one or more hydrophilic materials in the hydrophilic layer have reactivity with the reactive component to further enhance the durability, adhesion, and permanence of the reaction products of the reactive component. For example, some hydrophilic materials obtain some or all of their hydrophilic properties from hydroxyl groups, and these hydroxyl groups may also react with the transition metal complexes of organic acids of the fluid materials of this invention after application of the fluid material on the hydrophilic layer, thereby forming a more durable ink-accepting layer on the hydrophilic layer. A hydrophilic layer is also beneficial for the application of the typically polar, and often aqueous-based, fluid materials of this invention.

Suitable hydrophilic materials for the hydrophilic layer include, but are not limited to, polyvinyl alcohols and copolymers thereof; cellulosic polymers; polyacrylates and copolymers thereof; polymethacrylates and copolymers thereof; polymaleic anhydrides and derivatives and copolymers thereof; polyvinyl pyrrolidones and copolymers thereof; polyamides; inorganic polymers; and aluminum oxides. Preferred hydrophilic materials are aluminum oxides, including, but not limited to, aluminum boehmites; gamma-aluminum oxides; alpha-aluminum oxides; aluminum oxides formed by the oxidation of aluminum metal by oxygen; and aluminum oxides formed by an anodization process. In a preferred embodiment, the hydrophilic material is a polyvinyl alcohol or a copolymer thereof.

To promote the reaction of the reactive component after application of the fluid material on the hydrophilic or other receiving layer of the wet lithographic printing plates of the present invention, the hydrophilic or other receiving layer may further comprise a catalyst. Preferably, the catalyst is an alkaline material such as, for example, a tertiary amine. The fluid materials of this invention, which comprise transition metal complexes of organic acids, are typically acidic, and alkaline materials in the hydrophilic or other receiving layer generally promote the reaction of these transition metal complexes.

After the fluid material is applied on the hydrophilic or other receiving surface, the liquid carrier medium is typically removed to leave a solid layer comprising the transition metal complex of an organic acid on the hydrophilic or other receiving surface. This layer is then reacted to form a reaction product of the transition metal complex of an organic acid and thereby to form a solid ink-accepting, durable layer. FIG. 1 shows one embodiment of a lithographic printing plate of this invention for use in preparing positive working, wet lithographic printing plates. The ink-accepting layer 3 is in contact with the hydrophilic surface 2 of the support 1. The removal of the liquid carrier medium may be accomplished by a variety of conventional means such as, for example, forced ambient or hot air drying and absorption of the liquid carrier medium into the hydrophilic or other receiving surface.

The reaction of the reactive component after application to the hydrophilic or other receiving surface may be accomplished by a variety of means. For example, after removal of the liquid carrier medium, the solid layer comprising the transition metal complex, preferably a chromium complex, of an organic acid may react at ambient conditions to form a solid ink-accepting layer. Preferably, heat is utilized to react the transition metal complex, preferably a chromium complex, to form the ink-accepting layer. The ink-accepting layers of the present invention provide the good mechanical integrity and durability, as well as strong adhesion to the underlying layer, that are useful for wet lithographic printing plates.

The supports for the wet lithographic plates of the present invention may be a number of different supports, including the types known in the art as supports for lithographic printing plates. Suitable supports include, but are not limited to, papers, polymeric plastic films, and metals such as aluminum, steel, and chromium. For wet lithographic printing, a wide variety of papers, preferably those which are highly moisture resistant, may be used. Examples of suitable polymeric plastic films include, but are not limited to, polyesters such as polyethylene terephthalate, polycarbonates, polysulfones, and cellulose acetates. These supports by their intrinsic chemical nature may contain a hydrophilic surface on at least one surface such as, for example, the cellulosic surface of a paper or the surface of an aluminum support with aluminum oxide present. Alternatively, these supports may further comprise a hydrophilic layer applied on at least one surface of the support such as, for example, a hydrophilic coating layer comprising a hydrophilic material applied to polymeric plastic film, such as, for example, to polyethylene terephthalate plastic film.

Aluminum has long been known as a support for both wet and waterless lithographic printing plates. The processes of mechanical and electrochemical graining and of anodizing the surface of the aluminum to improve lithographic printing quality are well known in the art, such as, for example, described in *The Surface Treatment and Finishing of Aluminum and Its Alloys* by Wernick et al., Fifth Edition, Volumes 1 and 2, ASM International, Metals Park, Ohio, 1987. The types of aluminum supports suitable for use in the present invention may vary widely and include, but are not limited to, aluminum which has been grained; aluminum which has been grained and anodized; and aluminum which has been anodized without prior graining.

Lithograihic Printing Plates With Ink-Accepting Surface Layers for Use in Preparing Wet Lithogaphic Printing Plates The ink-accepting surface layers of the lithographic printing plates of the present invention, as illustrated in one embodiment in FIG. 1, for use in preparing positive working, wet lithographic printing plates comprise a reaction product of a transition metal complex of an organic acid. Preferably, the transition metal complex is a chromium complex, and more preferably, this chromium complex comprises a Werner complex of trivalent chromium and an organic carboxylic acid. In a most preferred embodiment, the organic carboxylic acid of the Werner complexes is selected from the group consisting of non-cyclic and cyclic carboxylic acids having 4 to 18 carbon atoms, such as, for example, myristic acid, and stearic acid.

Although the exact chemical structures of the reaction products of the transition metal complexes of the organic acids of this invention are not known and may vary widely depending on the nature of the specific starting complex, the presence of reactive materials and catalysts in the hydrophilic or other receiving surface of the media, and the specific reaction conditions, these reaction products comprise all or a substantial fraction of the organic acid content of the starting complex. For example, where the transition metal complex of the organic acid is a Werner complex of trivalent chromium and stearic acid, the reaction product of the complex comprises stearate groups. These long-chain groups impart an oleophilic, ink-accepting property to the ink-accepting layer and provide the ink-accepting properties needed for wet lithographic printing inks.

The hydrophilic layers of the lithographic printing plates of the present invention for use in preparing wet lithographic printing plates, which hydrophilic layer is optionally in contact with the ink-accepting layer, include, but are not limited to, the following hydrophilic materials: polyvinyl alcohols and copolymers thereof; cellulosic polymers; polyacrylates and copolymers thereof; polymethacrylates and copolymers thereof; polymaleic anhydrides and derivatives and copolymers thereof; polyvinylpyrrolidones and copolymers thereof; polyamides; inorganic polymers; and aluminum oxides. Suitable aluminum oxides include, but are not limited to, aluminum boehmites; gamma-aluminum oxides; alpha-aluminum oxides; aluminum oxides formed by the oxidation of aluminum metal by oxygen; and aluminum oxides formed by an anodization process. In a preferred embodiment, the hydrophilic layer comprises a polyvinyl alcohol or a copolymer thereof.

In a most preferred embodiment of the lithographic printing plates of the present invention for use in preparing positive working, wet lithographic printing plates, the reaction product of the transition metal complex of an organic acid comprises a reaction product of this complex with one or more hydrophilic materials in the hydrophilic layer.

Suitable supports include, but are not limited to, papers, polymeric plastic films, and metals, such as aluminum, steel, and chromium, as described herein.

Positive Working, Wet Lithogaphic Printing Plates for Laser Ablation Imaging

The ink-accepting layers of the positive working, wet lithographic printing plates of the present invention may be converted into imaged wet lithographic printing plates by laser-induced thermal ablation imaging. For example, laser-induced thermal ablation imaging may remove the ink-accepting layer in a desired imagewise pattern in the areas exposed to the laser to reveal or uncover a surface which is not ink-accepting and is ink-repelling in wet lithographic printing This is illustrated in one embodiment in FIG. 2, where, for example, the ink-accepting layer 3 has been removed by the ablation in certain desired areas to expose the ink-repelling surface 2 of the support 1 in a desired imagewise pattern. Preferably, this new surface after laser induced thermal ablation is a hydrophilic surface of the support, and this hydrophilic surface has ink-repelling properties for wet lithographic printing inks. This hydrophilic surface after laser imaging may be the original hydrophilic surface to which the ink-accepting layer is contacted or, alternatively, the hydrophilic surface after laser imaging may be a hydrophilic layer in the bulk of the support below the original hydrophilic surface.

The laser-induced thermal ablation of the positive working, wet lithographic printing plates of the present invention may be carried out using a wide variety of laser imaging techniques known in the art of laser-induced thermal ablation, including, but not limited to, the use of continuous and pulsed laser sources, and the use of laser radiation of various ultraviolet, visible, and infrared wavelengths. Preferably, the laser-induced thermal ablation of this invention is carried out using a continuous laser source of either visible or infrared radiation, such as, for example, with a YAG laser at its normal wavelength (1065 nm) or at its frequency-double wavelength (532 nm) or with a laser diode laser emitting at a wavelength in the range of 700 to 900 nm.

To increase the rate of imaging and the effectiveness of the laser-induced thermal ablation, the ink-accepting layer preferably further comprises a sensitizer that absorbs the wavelength of the incident laser radiation and promotes the rate of laser ablation imaging. For example, a useful sensitizer is carbon black which absorbs across the ultraviolet, visible, and infrared wavelength regions. Other useful sensitizers include, but are not limited to, organic dyes that have a high absorption coefficient at the wavelength of the laser radiation and very rapidly convert any absorbed photons into heat in order to provide an efficient temperature buildup for ablation in the ink-accepting layer. A wide variety of organic dyes for use as sensitizers is known in the art of laser-induced thermal ablation and may be utilized in the present invention. Examples of laser ablation imaging techniques and of sensitizers for use in laser ablation imaging are described in U.S. Pat. No. 5,353,705, and references therein, for a negative working wet lithographic printing plate and in U.S. Pat. No. 5,493,971, and references therein, for a positive working wet lithographic printing plate. An example of organic dyes for use as sensitizers in laser ablation imaging is IR 165, a tradename for a highly infrared-absorbing aminium dye from Deloz Safety, Lakeland, Fla., which may be utilized with lasers with infrared radiation wavelengths out to about 1300 nm and preferably with YAG lasers with an exposure wavelength of 1065 nm. The transition metal complexes of organic acid and their reaction products of the wet lithographic printing plates of this invention may absorb in the ultraviolet, visible, and infrared wavelength regions and may also function as a sensitizer. However, a particular feature of these transition metal complexes of organic acids is that they can provide their oleophilic and durable properties as a surface layer in extremely thin coatings, such as only one or a few monolayers thick, so that an added sensitizer with efficient ablation-sensitizing properties in typically preferred over increasing the thickness of the ink-accepting layer in order to enhance the absorption and sensitizer properties of the transition metal complexes of organic acids and their reaction products. An extremely low thickness of the ink-accepting layer is a significant benefit in reducing the laser exposure required to ablate the layer and to form the desired imaged wet lithographic printing plate and is a particular advantage of the present invention.

The positive working, wet lithographic plates imageable by laser radiation of the present invention may have a variety of constructions of layers for the support and for intermediate layers between the support and for intermediate layers between the support and the ink-accepting, water-insoluble surface or first layer comprising the reaction product of a transition metal complex of an organic acid. This flexibility in the design constructions of layers between the support and the surface layer is particularly enhanced by the capability of the surface layer to be very thin and relatively easy to remove by laser ablation imaging. One aspect of the present invention pertains to a positive working, wet lithographic plate imageable by laser radiation, comprising (a) an ink-accepting, oleophilic, and water-insoluble surface layer comprising a reaction product of a transition metal complex of an organic acid, as described herein; and (b) a support that bears a hydrophilic receiving layer comprising one or more hydrophilic materials, as described herein. One embodiment of this aspect is illustrated in FIG. 1.

The flexibility in design constructions that are possible with the novel surface layer comprising a reaction product of a transition metal complex of an organic acid of this invention includes single and multiple layers between the surface layer and the support. For example, another aspect of the present invention pertains to a positive working, wet lithographic plate imageable by laser radiation, comprising (a) an ink-accepting first layer comprising a reaction product of a transition metal complex of an organic acid, as described herein; (b) a hydrophilic second layer underlying the first layer; and (c) a support. Suitable hydrophilic materials for use in the hydrophilic second layer include, but are not limited to, polyvinyl alcohols and copolymers thereof; cellulosic polymers; polyacrylates and copolymers thereof; polymethacrylates and copolymers thereof; polymaleic anhydrides and derivatives and copolymers thereof; polyvinyl pyrrolidones and copolymers thereof; polyamides; inorganic polymers; and aluminum oxides. Preferred hydrophilic materials are aluminum oxides, including, but not limited to, aluminum boehmites; gamma-aluminum oxides; alpha-aluminum oxides; aluminum oxides formed by the oxidation of aluminum metal by oxygen; and aluminum oxides formed by an anodization process. In a preferred embodiment, the hydrophilic material is a polyvinyl alcohol or a copolymer thereof. In one embodiment, the support is hydrophilic. In one embodiment, the support is hydrophilic and the hydrophilic second layer is characterized by ablative absorption of laser radiation. Laser ablation imaging of this embodiment removes the first layer and at least part of the second layer in the exposed areas to reveal either the hydrophilic second layer or the hydrophilic support. In one embodiment, the support is oleophilic. Laser ablation imaging of this embodiment removes the first layer in the exposed areas to reveal the hydrophilic second layer. Suitable supports include, but are not limited to, papers, plastic polymeric films, and metals, such as aluminum, steel, and chromium. In one embodiment, the first layer further comprises a sensitizer, and preferably, the sensitizer is an infrared-absorbing compound, such as a carbon black or an organic dye.

Further showing the flexibility of design constructions possible, another aspect of this invention pertains to a positive working, wet lithographic plate imageable by laser radiation, comprising (a) an ink-accepting first layer comprising a reaction product of a transition metal complex of an organic acid, as described herein; (b) a second layer underlying the first layer, which second layer is characterized by ablative absorption of laser radiation; and (c) a hydrophilic support. In one embodiment, the second layer is oleophilic. Laser ablation imaging of this embodiment removes the first and second layers in the exposed areas to reveal the hydrophilic support. In one embodiment, the second layer is hydrophilic. Suitable hydrophilic materials for use in a hydrophilic second layer include, but are not limited to, polyvinyl alcohols and copolymers thereof; cellulosic polymers; polyacrylates and copolymers thereof; polymethacrylates and copolymers thereof; polymaleic anhydrides and derivatives and copolymers thereof; polyvinyl pyrrolidones and copolymers thereof; polyamides; inorganic polymers; and aluminum oxides. Preferred hydrophilic materials are aluminum oxides, including, but not limited to, aluminum boehmites; gamma-aluminum oxides; alpha-aluminum oxides; aluminum oxides formed by the oxidation of aluminum metal by oxygen; and aluminum oxides formed by an anodization process. In a preferred embodiment, the hydrophilic material is a polyvinyl alcohol or a copolymer thereof. Suitable supports include, but are not limited to, papers, plastic polymeric films, and metals, such as aluminum, steel, and chromium.

Still another aspect of the present invention pertains to a positive working, wet lithographic plate imageable by laser radiation, comprising (a) an ink-accepting first layer comprising a reaction product of a transition metal complex of an organic acid, as described herein, (b) a second layer underlying the first layer, which second layer is characterized by ablative absorption of laser radiation; (c) a hydrophilic third layer underlying the second layer; and (d) support. In one embodiment, the second layer is oleophilic. Laser ablation imaging of this embodiment removes the first and second layers in the exposed areas to reveal the hydrophilic third layer. In one embodiment, the hydrophilic third layer is characterized by the absence of ablative absorption of the laser radiation. Suitable hydrophilic materials for use in the hydrophilic third layer include, but are not limited to, polyvinyl alcohols and copolymers thereof; cellulosic polymers; polyacrylates and copolymers thereof; polymethacrylates and copolymers thereof; polymaleic anhydrides and derivatives and copolymers thereof; polyvinyl pyrrolidones and copolymers thereof; polyamides; inorganic polymers; and aluminum oxides. Preferred hydrophilic materials are aluminum oxides, including, but not limited to, aluminum boehmites; gamma-aluminum oxides; alpha-aluminum oxides; aluminum oxides formed by the oxidation of aluminum metal by oxygen; and aluminum oxides formed by an anodization process. In a preferred embodiment, the hydrophilic material is a polyvinyl alcohol or a copolymer thereof. In one embodiment, the support is oleophilic. In one embodiment, the support is hydrophilic, and laser ablation imaging of this embodiment may also remove the hydrophilic third layer in the exposed areas to reveal the hydrophilic support. Suitable supports include, but are not limited to, papers, plastic polymeric films, and metals, such as aluminum, steel, and chromium.

Imaged Wet Lithographic Printing Plates

Figure 2:
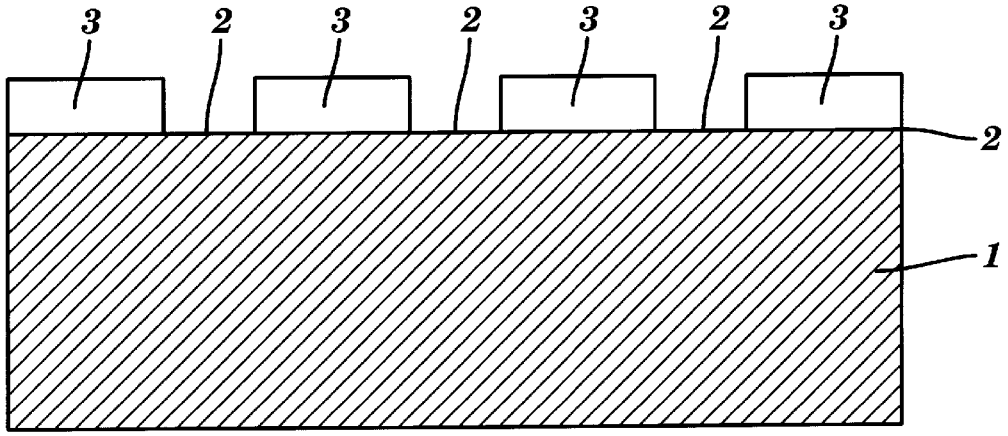
FIG. 2 shows a cross-section of one embodiment of an imaged wet lithographic printing plate of the present invention where an imagewise pattern of an ink-accepting layer is in contact with an ink-repelling hydrophilic surface of a support.

One aspect of the imaged wet lithographic printing plates of the present invention comprises (a) a support that bears a hydrophilic layer comprising at least one hydrophilic material; and, (b) an ink-accepting, oleophilic, and water-insoluble layer in a desired imagewise pattern overlying the hydrophilic layer, which ink-accepting layer comprises a reaction product of a transition metal complex of an organic acid, as described herein. FIG. 2 illustrates one embodiment of this aspect of the imaged wet lithographic printing plates of this invention where the ink-accepting layer 3 is in a desired imagewise pattern overlying the ink-repelling surface 2 of the support 1. As described herein, suitable methods to obtain these imaged wet lithographic printing plates include, but are not limited to, laser-induced thermal ablation of an ink-accepting layer in a desired imagewise pattern to reveal the hydrophilic layer and ink jet printing application of an ink-accepting layer in a desired imagewise pattern on the hydrophilic layer. As described herein, the reaction product of a transition metal complex of an organic acid has organic functional groups, such as, for example, long-chain alkyl groups that provide the oleophilic properties needed for use with wet lithographic printing inks. Preferably, the transition metal complex is a chromium complex, and more preferably, the chromium complex comprises a Werner complex of trivalent chromium and an organic carboxylic acid. Most preferably, the organic carboxylic acid of the Werner complex is selected from the group consisting of non-cyclic and cyclic carboxylic acids having 4 to 18 carbon atoms, such as, for example, myristic acid and stearic acid.

Suitable hydrophilic materials in the hydrophilic layer include, but are not limited to, polyvinyl alcohols and copolymers thereof; cellulosic polymers; polyacrylates and copolymers thereof; polymethacrylates and copolymers thereof; polymaleic anhydrides and derivatives and copolymers thereof; polyvinyl pyrrolidones and copolymers thereof; polyamides; inorganic polymers; and aluminum oxides. Suitable inorganic polymers include, but are not limited to aluminum boehmite, an alumina, a silicate, a silica, or combinations thereof. Suitable aluminum oxides include, but are not limited to, aluminum boehmites; gamma-aluminum oxides; alpha-aluminum oxides; aluminum oxides formed by the oxidation of aluminum metal by air or oxygen; and aluminum oxides formed by an anodization process. In a preferred embodiment, the hydrophilic layer comprises a polyvinyl alcohol or a copolymer thereof. Most preferably, the hydrophilic materials in the hydrophilic layer form a reaction product with the transition metal complex of an organic acid in the ink-accepting areas of the imaged wet lithographic printing plates.

Suitable supports for the imaged wet lithographic printing plates of the present invention include, but are not limited to, papers, polymeric plastic films, and metals, such as aluminum, steel, and chromium, as described herein.

Methods of Preparing Positive Working Wet Lithogaphic Printing Plates Imageable by Laser Radiation One aspect of the methods of preparing positive working, wet lithographic printing plates of this invention comprises the steps of (a) providing a support that bears a hydrophilic layer, as described herein; (b) applying a fluid material comprising a liquid carrier medium and a reactive component, which reactive component comprises a transition metal complex of an organic acid, as described herein, to the hydrophilic layer; (c) removing the liquid carrier medium; and, (d) reacting the reactive component, thereby forming an ink-accepting layer on the hydrophilic layer. Preferably, the transition metal complex is a chromium complex, and more preferably, the chromium complex comprises the Werner complex of trivalent chromium and an organic carboxylic acid. In a preferred embodiment of the methods of preparing the ink-accepting plates of this invention for use in preparing positive working, wet lithographic printing plates, the organic carboxylic acid of the Werner complex is selected from the group consisting of non-cyclic and cyclic carboxylic acids having 4 to 18 carbon atoms, such as, for example, myristic acid and stearic acid.

The application of the fluid material to the hydrophilic layer may be done by a variety of techniques, including conventional coating techniques such as, for example, reverse roll coating, gravure coating, slot extrusion coating, gap blade coating, and dip coating. Also, the fluid material may be an ink jet fluid marking material and the application of this fluid material to the hydrophilic layer, whether it is a full coverage of the surface or a desired imagewise pattern, may be carried out by an ink jet printing application, such as on a commercially available ink jet printer utilizing one of the conventional ink jet printing techniques such as, for example, thermal ink jet printing, piezoelectric ink jet printing, or continuous flow ink jet printing.

In a preferred embodiment, the reactive component in step (d) of the methods of preparing the positive working, wet lithographic plates of the present invention reacts upon exposure to heat. In a most preferred embodiment, the reactive component in step (d) reacts with one or more hydrophilic materials in the hydrophilic layer.

Suitable supports for the methods of preparing the positive working, wet lithographic printing plates of this invention include, but are not limited to, papers, polymeric plastic films, and metals, such as aluminum, steel, and chromium, as described herein.

Another aspect of the methods of preparing positive working, wet lithographic plates of this invention comprises the steps of (a) providing a hydrophilic support; and (b) forming an ink-accepting layer on the support, which ink-accepting layer comprises a reaction product of a transition metal complex of an organic acid. In a preferred embodiment, the transition metal complex comprises a chromium complex of an organic acid.

The methods of preparing positive working, wet lithographic printing plates of the present invention also include the application of fluid materials comprising the materials of any layers interposed between the support and the surface or first layer comprising the reaction product of a transition metal complex for an organic acid of this invention and the subsequent removal of any liquid carrier medium in the fluid materials to form the intermediate layer. One aspect of this invention pertains to methods of preparing positive working, wet lithographic printing plates imageable by laser radiation, which methods comprise the steps of (a) providing a support; (b) forming a hydrophilic layer on the support; and (c) forming an ink-accepting layer overlying the hydrophilic layer, which ink-accepting layer comprises a reaction product of a transition metal complex of an organic acid. In a preferred embodiment, the transition metal complex comprises a chromium complex for an organic acid. Another aspect of the present invention pertains to methods of preparing positive working, wet lithographic printing plates imageable by laser radiation, which methods comprise the steps of (a) providing a hydrophilic support; (b) forming an ablative-absorbing layer on the hydrophilic support; and (c) forming an ink-accepting layer overlying the ablative-absorbing layer, which ink-accepting layer comprises a reaction product of a transition metal complex of an organic acid. In a preferred embodiment, the transition metal complex comprises a chromium complex of an organic acid. Still another aspect of this invention pertains to methods of preparing positive working, wet lithographic printing plates imageable by laser radiation, which methods comprise the steps of (a) providing a support; (b) forming a hydrophilic layer or the support; (c) forming an ablative-absorbing layer overlying the hydrophilic layer; and (d) forming an ink-accepting layer overlying the ablative-absorbing layer, which ink-accepting layer comprises a reaction product of a transition metal complex of an organic acid. In a preferred embodiment, the transition metal complex comprises a chromium complex of an organic acid.

Methods of Imaging

One aspect of the methods of imaging of the present invention comprise the steps of (a) to (d) of the methods of preparing positive working, wet lithographic printing plates imageable by laser radiation, as described above, followed by a subsequent step (e) of exposing the ink-accepting layer to laser-induced thermal ablation in a desired imagewise pattern, thereby removing the ink-accepting layer in the exposed regions thereof to thereby reveal the hydrophilic layer of the support in the desired imagewise pattern. Preferably, the transition metal complex of the methods of imaging of this invention is a chromium complex, and more preferably, this chromium complex comprises a Werner complex of trivalent chromium and an organic carboxylic acid. Most preferably, the organic carboxylic acid of the Werner complex is selected from the group consisting of non-cyclic and cyclic organic carboxylic acids having 4 to 18 carbon atoms, such as, for example, myristic acid and stearic acid.

Suitable hydrophilic materials for the hydrophilic layer of the methods of imaging of the present invention include, but are not limited to, polyvinyl alcohols and copolymers thereof; cellulosic polymers; polyacrylates and copolymers thereof; polymethacrylates and copolymers thereof; polymaleic anhydrides and derivatives and copolymers thereof; polyamides; inorganic polymers; and aluminum oxides. Suitable aluminum oxides include, but are not limited to, aluminum boehmites; gamma-aluminum oxides; alpha-aluminum oxides; aluminum oxides formed by oxidation of aluminum metal by oxygen, and aluminum oxides formed by an anodization process. In a preferred embodiment, the hydrophilic layer comprises a polyvinyl alcohol or a copolymer thereof. In a most preferred embodiment, the ink-accepting layer comprises a reaction product of the transition metal complex of an organic acid with one or more hydrophilic materials in the hydrophilic layer.

Suitable supports for the methods of imaging of the present invention include, but are not limited to, papers, polymeric plastic films, and metals, such as aluminum, steel, and chromium, as described herein.

Another aspect of the methods of imaging of this invention comprises the steps of (a) providing a positive working, wet lithographic plate imageable by laser radiation, comprising (i) an ink-accepting, oleophilic, and water-insoluble surface layer comprising a reaction product of a transition metal complex of an organic acid, as described herein, and (ii) a support that bears a hydrophilic layer comprising one or more hydrophilic materials, as described herein; and, (b) imagewise directing laser radiation to ablate the ink-accepting surface layer in the exposed regions thereof to form an image. In one embodiment, subsequent to step (b), there is a further step (c) comprising contacting the plate with a cleaning solution to remove residue present from the exposed regions. In one embodiment, the cleaning solution comprises water. For example, the plate may be cleaned in further step (c) by rubbing with a cloth that has been wet with water or by contact with the fountain solution, which typically contains very high volume percentages of water, during the setup and operation of the wet lithographic printing press. The wide variety of cleaning solutions and post-imaging cleaning steps known in the art for cleaning laser imageable, wet lithographic printing plates may be utilized as the cleaning solutions in this invention, such as, for example, those described in U.S. Pat. Nos. 5,339,737; 5,353,705; 5,385,092; 5,487,338; and 5,493,971. A suitable cleaning solution does no damage either to the surface layer or to unexposed intermediate layers thereunder or to the support. The reacted, insoluble nature of the surface layers of this invention are advantageous in providing insolubility in contact to water and to a wide variety of fountain and cleaning solutions. In one embodiment, subsequent to further step (c), the plate is inked and used in press runs on a wet lithographic printing press. In one embodiment, the plate is mounted on a wet lithographic printing press before step (b) is carried out. This embodiment has the advantage of direct computer-to-press or on-press imaging of the positive working, wet lithographic printing plate instead of a separate off-press imaging step and subsequent mounting of the imaged plate on the printing press. In one embodiment of the methods of imaging of this invention, the positive working, wet lithographic printing plate imageable by laser radiation of step (a) comprises (i) an ink-accepting first layer comprising a reaction product of a transition metal complex of an organic acid, as described herein; (ii) a hydrophilic second layer underlying the first layer; and (iii) a support. In another embodiment of the methods of imaging of the present invention, the positive working, wet lithographic printing plate imageable by laser radiation of step (a) comprises (i) an ink-accepting first layer comprising a reaction product of a transition metal complex of an organic acid, as described herein; (ii) a second layer underlying the first layer, which second layer is characterized by ablative absorption of laser radiation; and (iii) a hydrophilic support. In this embodiment, the ablative-absorbing second layer may be either oleophilic or hydrophilic. If the ablative-absorbing second layer is oleophilic in this embodiment, the methods of imaging remove the first and second layers in the laser-exposed regions to reveal the hydrophilic support. In still another embodiment of the methods of imaging of this invention, the positive working, wet lithographic printing plate imageable by laser radiation of step (a) comprises (i) an ink-accepting first layer comprising a reaction product of a transition metal complex of an organic acid, as described herein; (ii) a second layer underlying the first layer, which second layer is characterized by ablative absorption of laser radiation; (iii) a hydrophilic third layer underlying the second layer; and (iv) a support. In this embodiment, the ablative-absorbing second layer may be oleophilic or hydrophilic. If the ablative-absorbing second layer is oleophilic in this embodiment, the methods of imaging remove the first and second layers in the laser-exposed regions to reveal the hydrophilic third layer, particularly when the hydrophilic third layer is characterized by the absence of ablative absorption of laser radiation. In this embodiment, the hydrophilic third layer may be characterized by the absence of ablative absorption of laser radiation.

Methods of Preparing Imaged Wet Lithographic Printing Plates with Ink Jet Fluid Materials The novel ink jet fluid marking material of the present invention comprises a liquid carrier and at least one organic or transition metal complex reactive component. The liquid carrier is water or organic solvents or combinations thereof. Choice of the specific liquid carrier depends on the specific ink jet printer and its compatible ink jet printing head and cartridge being used for the ink jet printing. It also depends on the specific reactive component selected. Compatibility with both the ink jet hardware and with the reactive component is important in the selection of the liquid carrier. The types of liquid carriers suitable for use with the different types of ink jet printheads is known in the art, for example, as described in U.S. Pat. No. 5,085,698. In general, the piezoelectric and continuous flow types of ink jet printheads have a wider latitude of acceptable liquid carriers than the thermal or bubble type of ink jet printhead. For example, piezoelectric ink jet printheads work acceptably with various non-aqueous or organic liquid carriers while thermal ink jet printheads typically need a high percentage of water or volatile organic solvent in the liquid carrier.

Likewise, the reactive components of this invention often have a compatibility with the types of liquid carriers that is known in the art. For example, some of the reactive components of this invention, such as isocyanates, ketenes, and acid anhydrides, are typically sufficiently reactive with water that they would only be compatible with non-aqueous or organic liquid carriers. If the compatibility is not known, it can be readily estimated by mixing the reactive component in the liquid carrier in the desired amounts and using conventional chemical and physical methods, such as quantitative analysis of any change or decomposition of the reactive component, to measure stability. This is not sufficient to insure that the reactive component will be compatible and stable in the ink jet printhead during the conditions of storage and printing and in the presence of other materials besides the liquid carrier which are typically included in the ink jet fluid composition. For this reason, the final selection of the suitable liquid carrier for each reactive component needs to be demonstrated in the specific ink jet printer to be utilized and with the complete ink jet fluid composition, including other additives, present.

The organic and transition metal complex reactive components of this invention are selected for their capability, in addition to being compatible and stable enough to be utilized in at least one type of ink jet printhead with a suitable liquid carrier, to form an oleophilic, water-insoluble, and durable image when printed on a hydrophilic receiving layer and subsequently exposed to an external energy source or other suitable means to cause the reaction of the reactive component. In the present invention it is preferred that the reactive component is an isocyanate, blocked isocyanate, diketene, diketene emulsion, polyamide epoxide, acid anhydride, acid chloride, or chromium complex of an organic acid. Examples of these reactive components include isocyanates sold under the LUPRANATE trade name by BASF Corporation, such as LUPRANATE M205; blocked isocyanates sold under the DESMODUR trade name by Bayer Corporation, such as DESMODUR BL3175; diketenes sold under the AQUAPEL trade name by Hercules Corporation; diketene emulsions sold under the HERCON trade name by Hercules Corporation, such as HERCON 79; polyamide epoxides sold under the POLYCUP trade name by Hercules Corporation, such as POLYCUP 172; acid anhydrides sold under the GANTREZ trade name by ISP Corporation, such as long alkyl chain vinyl ether-maleic anhydride copolymers; palmitoyl chloride from Aldrich Chemical Company; and chromium complexes of organic acids sold under the QUILON trade name by Dupont Corporation, such as QUILON C, a 25 to 30% by weight solution of the Werner complex of trivalent chromium and myristic or stearic acid in isopropyl alcohol, as described in *Quilon Chrome Complexes*, Dupont Corporation, April 1992. In a most preferred embodiment, the reactive component is a blocked isocyanate, diketene emulsion, or chromium complex of an organic acid.

While not wishing to be bound to a particular theory, the ink jet inks or fluids of the present invention achieve a unique combination of oleophilicity, water-insolubility, and durability upon ink jet printing and subsequent reaction which is not present in ink jet inks of the prior art, including those containing colorants with reactive groups or reactive additives and those containing titanate and silane coupling agents. This advantageous combination of properties is attributed in part to the superior film forming properties of the reactive components of the present invention. These film forming properties provide the good mechanical integrity or durability over a range of image thicknesses and the strong bonding to the receiving layer that are needed for demanding applications such as lithographic printing plates and for other archival, durable applications in general.

Another reactive component is an electron beam, ultraviolet, visible, or infrared radiation curable material. In a most preferred embodiment, the radiation curable material contains unsaturated acrylic or vinyl groups. With the proper selection of radiation-sensitive reactive groups and of oleophilic groups in these radiation curable materials, the unique combination of oleophilicity, durability, and water-insolubility properties described above can also be achieved with these film forming materials.

The media of the present invention is for use with the ink jet fluid marking material of the present invention and comprises a support that has a receiving layer containing at least one hydrophilic material. The selection of this hydrophilic material is made based on its performance in three main areas: receptivity to the ink jet fluid marking material to provide a high quality image with the desired resolution, amount, and uniformity; interaction with the reactive component in the ink jet fluid to provide a durable image; and the hydrophilic properties and water-fastness properties needed for high quality lithographic printing. For example, most aqueous-based ink jet fluids need a hydrophilic receiving surface for good image quality. The hydrophilic properties and water-fastness needed in lithographic printing are well known in the art.

Preferred hydrophilic materials for the methods of preparing imaged wet lithographic printing plates with ink jet fluid materials of the present invention are polyvinyl alcohols and copolymers thereof; cellulosic polymers; polyvinyl acetates and copolymers thereof; polyacrylates and copolymers thereof; polymethacrylates and copolymers thereof; polymaleic anhydrides and derivatives and copolymers thereof, polyvinyl acetals and copolymers thereof; polyvinyl pyrrolidones and copolymers thereof; polyamides; and inorganic polymers. In a most preferred embodiment, the hydrophilic material comprises polyvinyl alcohol or a copolymer thereof, aluminum boehmite, an alumina, a silicate, or a silica. The inorganic polymers are typically formed from a sol gel, colloidal particle deposition, or anodization process to provide a gel or network of inorganic polymer.

Although the supports for the media of this invention can be selected from a wide range of materials commonly used in lithographic printing plates with a basic requirement that the media with this support be capable of transport through the ink jet printing hardware where the media is required to be transported, the preferred supports are paper, plastic polymer film, or aluminum.

After the ink jet fluid marking material of the present invention is printed on the media of this invention, the reactive component needs to be reacted by exposure to an external energy source or other suitable means. For the non-radiation curable reactive components of the present invention, the preferred external energy source is heat. For the radiation curable reactive components of the present invention, the preferred external energy source is the radiation, such as ultraviolet radiation, to which the material is most efficiently sensitive. For some non-radiation curable reactive components such as some isocyanates, ambient conditions are sufficient means to provide an effective reaction.

In a preferred embodiment, a catalyst is added to the ink jet fluid marking material to increase the rate of reaction of the reactive component after printing and upon exposure to the external energy source or other suitable means to cause reaction. In a most preferred embodiment, the catalyst that is added is a metal complex, such as stannous stearate.

In another preferred embodiment, the receiving layer of the media also comprises a catalyst to increase the rate of reaction of the reactive component after printing and upon exposure to the external energy source or other suitable means to cause reaction. In a most preferred embodiment, the catalyst that is added to the receiving layer is an alkaline material. Some of the reactive components react under alkaline conditions, but are stable in acidic conditions. Thus, these reactive components must be in the ink jet fluid of the present invention in an acidic environment, but require the presence of an alkaline material in the receiving layer to cause the desired reactivity.

In another embodiment of the present invention, the reactive component in the ink jet fluid marking material reacts with the hydrophilic material in the receiving layer of the media. In a preferred embodiment, the reactive component that reacts with the hydrophilic material in the receiving layer is an isocyanate, blocked isocyanate, diketene, diketene emulsion, polyamide epoxide, acid anhydride, acid chloride, or chromium complex of an organic acid. In a most preferred embodiment, the reactive component that reacts with the hydrophilic material in the receiving layer is a blocked isocyanate, a diketene emulsion, or a chromium complex of an organic acid.

The novel method of preparing an imaged lithographic printing plate of the present invention comprises providing a lithographic plate blank having a support that bears a receiving layer containing at least one hydrophilic material. An image is formed on this receiving surface using an ink jet printer which prints an ink jet fluid marking material which comprises a liquid carrier medium and at least one organic or transition metal complex reactive component. After ink jet printing, the lithographic plate blank with the imaged pattern comprising the reactive component is exposed to an external energy source or other suitable means to cause the reaction of the reactive component. This forms an effective amount of an oleophilic and water-insoluble pattern on the lithographic plate blank, thereby preparing it for high quality lithographic printing.

In a preferred embodiment of the method of the present invention, the reactive component is an isocyanate, blocked isocyanate, diketene, diketene emulsion, polyamide epoxide, acid anhydride, acid chloride, or chromium complex of an organic acid. In a most preferred embodiment of the method of the present invention, the reactive component is a blocked isocyanate, a diketene emulsion, or a chromium complex of an organic acid.

The invention will now be more fully explained by the following examples. However, the scope of the invention is not intended to be limited to these examples.

EXAMPLE 1

An EPSON (trade name of Epson Corporation) black ink jet cartridge, catalog #5020047, was opened. After removing the internal sponge, the cartridge was rinsed thoroughly with dimethyl sulfoxide. An ink jet fluid consisting of 1 part of a blocked isocyanate, sold under the trade name of DESMODUR BL3175A by Bayer Corporation, and 4 parts of dimethyl sulfoxide was prepared and used to fill the cartridge. The cartridge was then taped shut and placed in the cartridge holder of an EPSON ink jet printer, a piezoelectric type desktop ink jet printer sold under the trade name of STYLUS COLOR IIS.

Images were jetted on to printing plates sold under the trade name of the GENIE brand. The images were heated for 5 minutes with a hot air gun set at 900° F. and held at 18 inches from the imaged plate.

The ink receptivity in the imaged areas only was found to be excellent by soaking the sheet under tap water for 30 seconds and then rubbing a standard black rubber-based offset ink on the imaged surface side followed by a water wash.

EXAMPLE 2

A HEWLETT PACKARD (trade name of Hewlett Packard Corporation) black ink jet cartridge, catalog # 51625A, was emptied by piercing the top plug and withdrawing the liquid ink with a pipette. The cartridge was then rinsed twice with a solution consisting of 3 parts of isopropyl alcohol and 2 parts of dimethyl sulfoxide. An ink jet fluid consisting of 4 parts of a chromium complex of an organic acid, sold as a 25% to 30% solution in isopropyl alcohol under the trade name of QUILON C by Dupont Corporation, and 1 part of isopropyl alcohol was prepared and used to fill the cartridge with the aid of a pipette. The cartridge was then placed in the cartridge holder of a HEWLETT PACKARD ink jet printer, a thermal type desktop ink jet printer sold under the trade name of HP540C, and imaged, treated with heat, and tested as described in Example 1. The ink receptivity in the imaged areas only was found to be excellent and similar to the results in Example 1.

EXAMPLE 3

The cartridge containing QUILON C from Example 2 was placed in the cartridge holder of an ENCAD (trade name of Encad Corporation) ink jet printer, a thermal type 36 inch wide ink jet printer sold under the trade name of NOVAJET III. Imaging, heat treatment, and testing as described in Example 1 gave results similar to the results in Example 1.

EXAMPLE 4

The procedure of Example 2 was followed except that a diketene emulsion, sold as a 10% solids emulsion by Hercules Corporation under the trade name of HERCON 79, was substituted for the ink jet fluid containing the QUILON C. The ink receptivity was found to be in the imaged areas only and similar to the results in Example 2.

EXAMPLE 5

The procedure of Example 1 was followed except that the imaging was done on a coated white opaque polyester film, sold by Epson Corporation under the trade name of EPSON GLOSSY PAPER. Analysis of the hydrophilic coating on the polyester film showed it to contain both aluminum boehmite inorganic polymer and a polyvinyl alcohol. The ink receptivity in the imaged areas only was found to be excellent and similar to the results in Example 1.

EXAMPLE 6

The imaged and heat treated plates from Examples 1 and 2 were printed on a conventional lithographic wet offset press using an oil-based black ink from Van Son Corporation and a fountain solution diluted by a ratio of 1:10 from a concentrate sold by Itek Corporation under the trade name of MEGAPLATE FOUNTAIN CONCENTRATE. Satisfactory image quality was achieved on the printed paper sheets throughout a continuous run of 3,000 impressions While the invention has been described in detail and with reference to specific embodiments thereof, it will be apparent to one skilled in the art that various changes and modifications can be made without departing from the spirit and scope thereof.

What is claimed is:

1. An imaged wet lithographic printing plate comprising:

(a) a support that bears a hydrophilic layer comprising at least one hydrophilic material; and, (b) an oleophilic, water-insoluble layer in a desired imagewise pattern overlying said hydrophilic layer, said oleophilic layer comprising a reaction product of a transition metal complex of an organic acid.

2. The imaged plate of claim 1, wherein said transition metal complex comprises a chromium complex of an organic acid.

3. The imaged plate of claim 2, wherein said chromium complex comprises a Werner complex of trivalent chromium and an organic carboxylic acid.

4. The imaged plate of claim 3, wherein said organic carboxylic acid is selected from the group consisting of myristic acid and stearic acid.

5. The imaged plate of claim 1, wherein said hydrophilic material is selected from the group consisting of:

polyvinyl alcohols and copolymers thereof, cellulosic polymers, polyvinyl acetates and copolymers thereof, polyacrylates and copolymers thereof, polymethacrylates and copolymers thereof, polyacrylates and copolymers thereof, polymethacrylates and copolymers thereof, polymaleic anhydrides and derivatives and copolymers thereof, polyvinyl acetals and copolymers thereof, polyvinyl pyrrolidones and copolymers thereof, polyamides, and inorganic polymers.

6. The imaged plate of claim 5, wherein said inorganic polymer is aluminum boehmite, an alumina, a silicate, a silica, or combinations thereof.

7. The imaged plate of claim 1, wherein said hydrophilic material comprises a polyvinyl alcohol or a copolymer thereof.

8. The imaged plate of claim 1, wherein said reaction product comprises a reaction product of said transition metal complex with said at least one hydrophilic material of said hydrophilic layer.

9. The imaged plate of claim 1, wherein said support is a paper.

10. The imaged plate of claim 1, wherein said support is a plastic polymeric film.

11. The imaged plate of claim 1, wherein said support is a metal.

12. The imaged plate of claim 1, wherein said support is aluminum.

13. An imaged wet lithographic printing plate comprising:

(a) a support that bears a hydrophilic layer comprising at least one hydrophilic material; and, (b) an oleophilic, water-insoluble layer in a desired imagewise pattern overlying said hydrophilic layer, said oleophilic layer comprising a reaction product of a chromium complex of an organic acid.

14. A method of preparing an imaged wet lithographic printing plate, which method comprises the steps of:

(a) providing a support that bears a hydrophilic layer comprising one or more hydrophilic materials;

(b) applying a fluid material comprising a liquid carrier medium and a reactive component, which reactive component comprises a transition metal complex of an organic acid, to said hydrophilic layer;

(c) removing said liquid carrier medium;

(d) reacting said reactive component, thereby forming an ink-accepting, oleophilic, and water-insoluble layer on said hydrophilic layer; and, (e) exposing said ink-accepting layer to laser radiation in a desired imagewise pattern, thereby ablating said ink-accepting layer in the exposed regions thereof to thereby reveal the hydrophilic layer of said support in said desired imagewise pattern.

15. The method of claim 14, wherein said transition metal complex comprises a chromium complex of an organic acid.

16. The method of claim 15, wherein said chromium complex comprises a Werner complex of trivalent chromium and an organic carboxylic acid.

17. The method of claim 16, wherein said organic acid is selected from the group consisting of myristic acid and stearic acid.

18. The method of claim 14, wherein one or more of said hydrophilic materials is selected from the group consisting of:

polyvinyl alcohols and copolymers thereof, cellulosic polymers, polyvinyl acetates and copolymers thereof, polyacrylates and copolymers thereof, polymethacrylates and copolymers thereof, polymaleic anhydrides and derivatives and copolymers thereof, polyvinyl acetals and copolymers thereof, polyvinyl pyrrolidones and copolymers thereof, polyamides, inorganic polymers, and aluminum oxides.

19. The method of claim 18, wherein said inorganic polymer is aluminum boehmite, an alumina, a silicate, a silica, or combinations thereof.

20. The method of claim 18, wherein said aluminum oxide is selected from the group consisting of:

aluminum boehmites, gamma-aluminum oxides, alpha-aluminum oxides, aluminum oxides formed by the oxidation of aluminum metal by oxygen, and aluminum oxides formed by an anodization process.

21. The method of claim 14, wherein said one or more hydrophilic materials comprises a polyvinyl alcohol or a copolymer thereof.

22. The method of claim 14, wherein, in step (d), said reactive component reacts with said one or more hydrophilic materials.

23. The method of claim 14, wherein said support is a paper.

24. The method of claim 14, wherein said support is a plastic polymeric film.

25. The method of claim 14, wherein said support is a metal.

26. The method of claim 14, wherein said support is aluminum.

27. The method of claim 14, wherein said fluid material further comprises a sensitizer.

28. The method of claim 27, wherein said sensitizer is an infrared-absorbing compound.

29. A positive working, wet lithographic plate imageable by laser radiation, said plate comprising:

(a) an ink-accepting, oleophilic, and water-insoluble surface layer comprising a reaction product of a transition metal complex of an organic acid; and, (b) a support that bears a hydrophilic receiving layer comprising one or more hydrophilic materials.

30. The plate of claim 29, wherein said transition metal complex comprises a chromium complex of an organic acid.

31. The plate of claim 30, wherein said chromium complex comprises a Werner complex of trivalent chromium and an organic carboxylic acid.

32. The plate of claim 29, wherein one or more of said hydrophilic materials is selected from the group consisting of:

polyvinyl alcohols and copolymers thereof, cellulosic polymers, polyvinyl acetates and copolymers thereof, polyacrylates and copolymers thereof, polymethacrylates and copolymers thereof, polymaleic anhydrides and derivatives and copolymers thereof, polyvinyl acetals and copolymers thereof, polyvinyl pyrrolidones and copolymers thereof, polyamides, inorganic polymers, and aluminum oxides.

33. The plate of claim 32, wherein said aluminum oxide is selected from the group consisting of:

aluminum boehmites, ganmma-aluminum oxides, alpha-aluminum oxides, aluminum oxides formed by the oxidation of aluminum metal by oxygen, and aluminum oxides formed by an anodization process.

34. The plate of claim 29, wherein one or more of said hydrophilic materials comprises a polyvinyl alcohol or a copolymer thereof.

35. The plate of claim 29, wherein said support is a paper.

36. The plate of claim 29, wherein said support is a plastic polymeric film.

37. The plate of claim 29, wherein said support is a metal.

38. The plate of claim 29, wherein said support is aluminum.

39. A positive working wet lithogaphic plate imageable by laser radiation, said plate comprising:

(a) an ink-accepting, oleophilic, and water-insoluble surface layer comprising a reaction product of a transition metal complex of an organic acid; and, (b) a support that bears a hydrophilic receiving layer comprising one or more hydrophilic materials;

wherein said surface layer further comprises a sensitizer.

40. The plate of claim 39, wherein said sensitizer is an infrared-absorbing compound.

41. A positive working, wet lithographic printing plate imageable by laser radiation, said plate comprising:

(a) an ink-accepting first layer comprising a reaction product of a transition metal complex of an organic acid;

(b) a hydrophilic second layer underlying said first layer; and, (c) a support.

42. The plate of claim 41, wherein said transition metal complex comprises a chromium complex of an organic acid.

43. The plate of claim 42, wherein said chromium complex comprises a Werner complex of trivalent chromium and an organic carboxylic acid.

44. The plate of claim 41, wherein said second layer comprises one or more hydrophilic materials selected from the group consisting of:

polyvinyl alcohols and copolymers thereof, cellulosic polymers, polyvinyl acetates and copolymers thereof, polyacrylates and copolymers thereof, polymethacrylates and copolymers thereof, polymaleic anhydrides and derivatives and copolymers thereof, polyvinyl acetals and copolymers thereof, polyvinyl pyrrolidones and copolymers thereof, polyamides, inorganic polymers, and aluminum oxides.

45. The plate of claim 44, wherein said aluminum oxide is selected from the group consisting of:

aluminum boehmites, gamma-aluminum oxides, alpha-aluminum oxides, aluminum oxides formed by the oxidation of aluminum metal by oxygen, and aluminum oxides formed by an anodization process.

46. The plate of claim 41, wherein said second layer comprises a polyvinyl alcohol or a copolymer thereof.

47. The plate of claim 41, wherein said support is a paper.

48. The plate of claim 41, wherein said support is a plastic polymeric film.

49. The plate of claim 41, wherein said support is a metal.

50. The plate of claim 41, wherein said support is aluminum.

51. A positive working, wet lithographic printing plate imageable by laser radiation, said plate comprising:

(a) an ink-accepting first layer comprising a reaction product of a transition metal complex of an organic acid;

(b) a hydrophilic second layer underlying said first layer; and, (c) a support;

wherein said support is hydrophilic.

52. The plate of claim 51, wherein said second layer is characterized by ablative absorption of said laser radiation.

53. A positive working wet lithographic printing plate imageable by laser radiation, said plate comprising:

(a) an ink-accepting first layer comprising a reaction product of a transition metal complex of an organic acid;

(b) a hydrophilic second layer underlying said first layer; and, (c) a support;

wherein said support is oleophilic.

54. A positive working wet lithographic printing plate imageable by laser radiation, said plate comprising:

(a) an ink-accepting first layer comprising a reaction product of a transition metal complex of an organic acid;

(b) a hydrophilic second layer underlying said first layer; and, (c) a support;

wherein said surface layer further comprises a sensitizer.

55. The plate of claim 54, wherein said sensitizer is an infrared-absorbing compound.

56. A positive working, wet lithographic printing plate imageable by laser radiation, said plate comprising:

(a) an ink-accepting first layer comprising a reaction product of a transition metal complex of an organic acid;

(b) a second layer underlying said first layer, said second layer being characterized by ablative absorption of laser radiation; and, (c) a hydrophilic support.

57. The plate of claim 56, wherein said transition metal complex comprises a chromium complex of an organic acid.

58. The plate of claim 57, wherein said chromium complex comprises a Werner complex of trivalent chromium and an organic carboxylic acid.

59. The plate of claim 56, wherein said second layer is oleophilic.

60. The plate of claim 56, wherein said second layer is hydrophilic.

61. The plate of claim 56, wherein said second layer comprises one or more hydrophilic materials selected from the group consisting of:

polyvinyl alcohols and copolymers thereof, cellulosic polymers, polyvinyl acetates and copolymers thereof, polyacrylates and copolymers thereof, polymethacrylates and copolymers thereof, polymaleic anhydrides and derivatives and copolymers thereof, polyvinyl acetals and copolymers thereof, polyvinyl pyrrolidones and copolymers thereof, polyamides, inorganic polymers, and aluminum oxides.

62. The plate of claim 61, wherein said aluminum oxide is selected from the group consisting of:

aluminum boehmites, gamma-aluminum oxides, alpha-aluminum oxides, aluminum oxides formed by the oxidation of aluminum metal by oxygen, and aluminum oxides formed by an anodization process.

63. The plate of claim 56, wherein said second layer comprises a polyvinyl alcohol or a copolymer thereof.

64. The plate of claim 56, wherein said support is a paper.

65. The plate of claim 56, wherein said support is a plastic polymeric film.

66. The plate of claim 56, wherein said support is a metal.

67. The plate of claim 56, wherein said support is aluminum.

68. A positive working, wet lithographic printing plate imageable by laser radiation, said plate comprising:

(a) an ink-accepting first layer comprising a reaction product of a transition metal complex of an organic acid;

(b) a second layer underlying said first layer, said second layer being characterized by ablative absorption of laser radiation;

(c) a hydrophilic third layer underlying said second layer; and, (d) a support.

69. The plate of claim 68, wherein said transition metal complex comprises a chromium complex of an organic acid.

70. The plate of claim 69, wherein said chromium complex comprises a Werner complex of trivalent chromium and an organic carboxylic acid.

71. The plate of claim 68, wherein said second layer is oleophilic.

72. The plate of claim 68, wherein said second layer is hydrophilic.

73. The plate of claim 68, wherein said third layer is characterized by the absence of ablative absorption of said laser radiation.

74. The plate of claim 68, wherein said third layer comprises one or more hydrophilic materials selected from the group consisting of:

polyvinyl alcohols and copolymers thereof, cellulosic polymers, polyvinyl acetates and copolymers thereof, polyacrylates and copolymers thereof, polymethacrylates and copolymers thereof, polymaleic anhydrides and derivatives and copolymers thereof, polyvinyl acetals and copolymers thereof, polyvinyl pyrrolidones and copolymers thereof, polyamides, inorganic polymers, and aluminum oxides.

75. The plate of claim 74, wherein said aluminum oxide is selected from the group consisting of:

aluminum boehmites, gamma-aluminum oxides, alpha-aluminum oxides, aluminum oxides formed by the oxidation of aluminum metal by oxygen, and aluminum oxides formed by an anodization process.

76. The plate of claim 74, wherein said third layer comprises a polyvinyl alcohol or a copolymer thereof.

77. The plate of claim 74, wherein said support is oleophilic.

78. The plate of claim 74, wherein said support is hydrophilic.

79. The plate of claim 74, wherein said support is a paper.

80. The plate of claim 74, wherein said support is a plastic polymeric film.

81. The plate of claim 74, wherein said support is a metal.

82. The plate of claim 74, wherein said support is aluminum.

83. A method of preparing a positive working, wet lithographic printing plate imageable by laser radiation, said method comprising the steps of:

(a) providing a hydrophilic support; and (b) forming an ink-accepting layer on said support, said ink-accepting layer comprising a reaction product of a transition metal complex of an organic acid.

84. The method of claim 83, wherein said transition metal complex comprises a chromium complex of an organic acid.

85. A method of preparing a positive working, wet lithographic printing plate imageable by laser radiation, said method comprising the steps of:

(a) providing a support;

(b) forming a hydrophilic layer on said support; and, (c) forming an ink-accepting layer overlying said hydrophilic layer, said ink-accepting layer comprising a reaction product of a transition metal complex of an organic acid.

86. The method of claim 85, wherein said transition metal complex comprises a chromium complex of an organic acid.

87. A method of preparing a positive working, wet lithographic printing plate imageable by laser radiation, said method comprising the steps of:

(a) providing a hydrophilic support;

(b) forming an ablative-absorbing layer on said support; and, (c) forming an ink-accepting layer overlying said ablative-absorbing layer, said ink-accepting layer comprising a reaction product of a transition metal complex of an organic acid.

88. The method of claims 87, wherein said transition metal complex comprises a chromium complex of an organic acid.

89. A method of preparing a positive working, wet lithographic printing plate imageable by laser radiation, said method comprising the steps of:

(a) providing a support;

(b) forming a hydrophilic layer on said support;

(c) forming an ablative-absorbing layer overlying said hydrophilic layer; and, (d) forming an ink-accepting layer overlying said ablative-absorbing layer, said ink-accepting layer comprising a reaction product of a transition metal complex of an organic acid.

90. The method of claim 89, wherein said transition metal complex comprises a chromium complex of an organic acid.

91. A method of imaging comprising the steps of:

(a) providing a positive working, wet lithographic plate imageable by laser radiation, comprising:

(i) an ink-accepting, oleophilic, and water-insoluble surface layer comprising a reaction product of a transition metal complex of an organic acid; and, (ii) a support that bears a hydrophilic layer comprising one or more hydrophilic materials; and, (b) imagewise directing laser radiation to ablate said surface layer in the exposed regions thereof to form an image.

92. The method of claim 91, wherein, subsequent to step (b), there is a further step (c) comprising contacting said plate with a cleaning solution to remove residue present from said exposed regions.

93. The method of claims 92, wherein, subsequent to further step (c), said plate is inked and used in press runs.

94. The method of claim 92, wherein said cleaning solution comprises water.

95. The method of claim 91, wherein said plate is mounted on a printing press before step (b) is carried out.

96. A method of imaging comprising the steps of:

(a) providing a positive working, wet lithographic printing plate imageable by laser radiation, said plate comprising:

(i) an ink-accepting first layer comprising a reaction product of a transition metal complex of an organic acid;

(ii) a hydrophilic second layer underlying said first layer; and, (iii) a support; and, (b) imagewise directing laser radiation to ablate said first layer in the exposed regions thereof to form an image.

97. The method of claim 96, wherein, subsequent to step (b), there is a further step (c) comprising contacting said plate with a cleaning solution to remove residue present from said exposed regions.

98. The method of claim 97, wherein, subsequent to further step (c), said plate is inked and used in press runs.

99. The method of claim 97, wherein said cleaning solution comprises water.

100. The method of claim 96, wherein said plate is mounted on a printing press before step (b) is carried out.

101. A method of imaging comprising the steps of:

(a) providing a positive working, wet lithographic printing plate imageable by laser radiation, said plate comprising:

(i) an ink-accepting first layer comprising a reaction product of a transition metal complex of an organic acid;

(ii) a second layer underlying said first layer, said second layer being characterized by ablative absorption of laser radiation; and, (iii) a hydrophilic support; and, (b) imagewise directing laser radiation to ablate said first and second layers in the exposed regions thereof to form an image.

102. The method of claim 101, wherein, subsequent to step (b), there is a further step (c) comprising contacting said plate with a cleaning solution to remove residue present from said exposed regions.

103. The method of claim 102, wherein, subsequent to further step (c), said plate is inked and used in press runs.

104. The method of claim 102, wherein said cleaning solution comprises water.

105. The method of claim 101, wherein said plate is mounted on a printing press before step (b) is carried out.

106. The method of claim 101, wherein said second layer is oleophilic.

107. The method of claim 101, wherein said second layer is hydrophilic.

108. A method of imaging comprising the steps of:

(a) providing a positive working, wet lithographic printing plate imageable by laser radiation, said plate comprising:

(i) an ink-accepting first layer comprising a reaction product of a transition metal complex of an organic acid;

(ii) a second layer underlying said first layer, said second layer being characterized by ablative absorption of laser radiation;

(iii) a hydrophilic third layer underlying said second layer; and, (iv) a support; and, (b) imagewise directing laser radiation to ablate said first and second layers in the exposed regions thereof to form an image.

109. The method of claim 108, wherein, subsequent to step (b), there is a further step (c) comprising contacting said plate with a cleaning solution to remove residue present from said exposed regions.

110. The method of claims 109, wherein, subsequent to further step (c), said plate is inked and used in press runs.

111. The method of claim 109, wherein said cleaning solution comprises water.

112. The method of claim 108, wherein said plate is mounted on a printing press before step (b) is carried out.

113. The method of claim 108, wherein said second layer is oleophilic.

114. The method of claim 108, wherein said second layer is hydrophilic.

115. The method of claim 108, wherein said third layer is characterized by the absence of ablative absorption of said laser radiation.

* * * * *